US011834831B2

(12) United States Patent
Leitch

(10) Patent No.: US 11,834,831 B2
(45) **Date of Patent: *Dec. 5, 2023**

(54) ROOFING SHINGLES WITH REGISTERED SELF-SEAL STRIP PATTERNS

(71) Applicant: BMIC LLC, Dallas, TX (US)

(72) Inventor: Olan T. Leitch, Mt. Juliet, TN (US)

(73) Assignee: BMIC LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/826,308

(22) Filed: May 27, 2022

(65) Prior Publication Data

US 2022/0282487 A1 Sep. 8, 2022

Related U.S. Application Data

(63) Continuation of application No. 17/144,220, filed on Jan. 8, 2021, now Pat. No. 11,346,108.

(60) Provisional application No. 62/959,236, filed on Jan. 10, 2020.

(51) Int. Cl.

| | |
|---|---|
| ***E04D 1/26*** | (2006.01) |
| ***E04D 1/00*** | (2006.01) |
| ***E04D 1/34*** | (2006.01) |

(52) U.S. Cl.

CPC ..... *E04D 1/26* (2013.01); *E04D 1/29* (2019.08); *E04D 1/34* (2013.01); *E04D 2001/3435* (2013.01); *E04D 2001/3447* (2013.01)

(58) Field of Classification Search

CPC .... E04D 1/26; E04D 1/29; E04D 1/34; E04D 2001/3435; E04D 2001/3447

See application file for complete search history.

(56) References Cited

U.S. PATENT DOCUMENTS

| | | | | |
|---|---|---|---|---|
| 2,666,402 A | | 1/1954 | Clarvoe | |
| 3,003,906 A | | 10/1961 | Fasold et al. | |
| 3,080,683 A | | 3/1963 | Sallie | |
| 3,138,897 A | | 6/1964 | McCorkle | |
| 3,239,992 A | | 3/1966 | Hodgson | |
| 3,247,631 A | * | 4/1966 | Lovness | E04D 1/26 208/3 |
| 3,252,257 A | | 5/1966 | Price et al. | |
| 3,641,932 A | | 2/1972 | Behringer | |
| 4,189,886 A | | 2/1980 | Frohlich et al. | |
| 4,287,846 A | | 9/1981 | Klein | |
| 4,439,955 A | | 4/1984 | Freiborg | |
| 4,470,237 A | * | 9/1984 | Lincoln | E04D 1/29 427/373 |
| 4,835,929 A | | 6/1989 | Bondoc et al. | |
| 5,094,042 A | | 3/1992 | Freborg | |
| 5,122,095 A | | 6/1992 | Wolfert | |

(Continued)

FOREIGN PATENT DOCUMENTS

CA 3023371 A1 11/2017

*Primary Examiner* — Theodore V Adamos

(74) *Attorney, Agent, or Firm* — WOMBLE BOND DICKINSON (US) LLP

(57) ABSTRACT

Shingles have self-seal strips with features that include sealant dashes or dots separated by drainage gaps. The self-seal strips are registered with each shingle so that the features are positioned at the same locations on each shingle. A method of making such shingles includes synchronizing the rotation of sealant applicator wheels with the shingle chop cutter so that cuts are made at repeated designated locations along the applied self-seal strips.

20 Claims, 4 Drawing Sheets

(56) References Cited

U.S. PATENT DOCUMENTS 5,239,802 A 8/1993 Robinson
5,271,201 A 12/1993 Noone et al.
5,288,269 A 2/1994 Hansen
5,377,459 A 1/1995 Freiborg
5,419,941 A 5/1995 Noone et al.
5,693,142 A 12/1997 Pedigrew et al.
5,921,863 A 7/1999 Sells
5,950,387 A * 9/1999 Stahl ..... E04D 1/29 52/748.1
D422,095 S 3/2000 Thagard, III et al.
6,083,592 A 7/2000 Chich
6,125,602 A 10/2000 Freiborg et al.
6,298,613 B1 10/2001 Coulton et al.
6,305,138 B1 * 10/2001 Stahl ..... E04D 1/26 52/316
6,308,472 B1 10/2001 Coulton et al.
6,351,913 B1 3/2002 Freiborg et al.
6,361,434 B1 3/2002 Brandon
6,813,866 B2 11/2004 Naipawer, III
6,981,916 B2 1/2006 Coulton
7,204,063 B2 4/2007 Kandalgaonkar
7,594,363 B2 9/2009 Polumbus et al.
7,604,536 B2 10/2009 Coulton et al.
7,921,606 B2 4/2011 Quaranta et al.
8,137,757 B2 3/2012 Collins et al.
8,240,100 B2 8/2012 Kalkanoglu et al.
8,266,861 B2 9/2012 Koch et al.
8,371,072 B1 2/2013 Shanes et al.
8,371,085 B2 2/2013 Koch
8,453,408 B2 6/2013 Kalkanoglu et al.
8,613,165 B2 12/2013 Bleil et al.
8,820,020 B2 9/2014 Koch et al.
8,820,021 B2 9/2014 Kalkanoglu et al.
8,839,576 B1 9/2014 Newcomb
8,898,987 B1 * 12/2014 Amatruda ..... E04D 1/28 52/557
8,915,037 B2 12/2014 Jenkins
9,017,791 B2 4/2015 Grubka et al.
9,097,020 B2 8/2015 Grubka et al.
9,151,055 B2 10/2015 Grubka
9,200,453 B2 12/2015 Kerwood-Winslow et al.
9,290,943 B2 3/2016 Grubka et al.
9,428,916 B2 8/2016 Railkar et al.
9,482,007 B2 11/2016 Grubka et al.
9,758,970 B2 9/2017 Grubka et al.
9,795,981 B2 10/2017 Svec
10,196,823 B2 2/2019 Rotter
10,253,502 B2 4/2019 Grube et al.
10,358,824 B2 7/2019 Aschenbeck et al.
10,538,918 B2 1/2020 Aschenbeck et al.
10,544,590 B2 1/2020 Jenkins
10,787,814 B2 9/2020 Dugue et al.
10,907,352 B2 2/2021 Aschenbeck et al.
11,203,871 B2 12/2021 Duque et al.
2002/0000068 A1 1/2002 Freiborg et al.
2002/0032000 A1 3/2002 Lawless, III et al.
2003/0093958 A1 5/2003 Freiborg et al.
2003/0215594 A1 11/2003 Hamdar et al.
2004/0206012 A1 10/2004 Pressutti et al.
2005/0126088 A1 6/2005 Rotter
2005/0193673 A1 9/2005 Rodrigues et al.
2006/0096189 A1 5/2006 Pavlansky et al.
2006/0265990 A1 11/2006 Kalkanoglu et al.
2007/0266665 A1 11/2007 Todd et al.
2008/0220714 A1 9/2008 Caruso et al.
2010/0192500 A1 8/2010 Koch
2010/0192501 A1 8/2010 Koch et al.
2011/0005158 A1 1/2011 Kailey et al.
2011/0061326 A1 3/2011 Jenkins
2011/0126485 A1 6/2011 Bleil et al.
2011/0151170 A1 6/2011 Grubka et al.
2012/0174517 A1 * 7/2012 Jenkins ..... B32B 37/1292 52/553
2013/0025225 A1 1/2013 Vermilion et al.
2013/0042540 A1 2/2013 Atchley
2014/0179220 A1 6/2014 Railkar et al.
2015/0089895 A1 4/2015 Leitch
2016/0024792 A1 1/2016 Grubka et al.
2016/0186438 A1 6/2016 Montojo et al.
2017/0321423 A1 * 11/2017 Aschenbeck ..... E04D 1/26
2018/0030732 A1 2/2018 Duque et al.
2018/0087274 A1 3/2018 Grubka et al.
2018/0163405 A1 6/2018 Grubka
2019/0360208 A1 * 11/2019 Collins ..... E04D 1/20
2020/0040582 A1 * 2/2020 Boss ..... E04D 1/20
2020/0190804 A1 6/2020 Haynes et al.
2020/0325684 A1 10/2020 Duque et al.
2021/0108416 A1 4/2021 Aschenbeck et al.
2021/0214945 A1 7/2021 Leitch
2021/0276036 A1 9/2021 Svec et al.
2022/0178143 A1 6/2022 Duque et al.
2022/0275645 A1 9/2022 Duque et al.

* cited by examiner

ROOFING SHINGLES WITH REGISTERED SELF-SEAL STRIP PATTERNS

REFERENCE TO RELATED APPLICATION

The present Patent Applications is a continuation of U.S. patent application Ser. No. 17/144,220, filed Jan. 8, 2021, and claims the benefit of U.S. Provisional Application No. 62/959,236, filed Jan. 10, 2020.

INCORPORATION BY REFERENCE

The disclosures made in U.S. patent application Ser. No. 17/144,220, filed Jan. 8, 2021, and U.S. Provisional Application No. 62/959,236, filed Jan. 10, 2020, are specifically incorporated by reference herein as if set forth in their entirety.

TECHNICAL FIELD

This disclosure relates generally to roofing shingles and more specifically to self-seal strips applied to roofing shingles to adhere overlapping shingles together.

BACKGROUND

Traditional shingles have strips of adhesive sealant applied along their length in areas where shingles in one course will overlap shingles of a next lower course. Such strips commonly are referred to as "self-seal strips." In some cases, self-seal strips are applied to the top surfaces of underlying shingles. In other cases, self-seal strips are applied to the bottom surfaces of overlying shingles. They may be applied in both locations so that the self-seal strips of two overlapping shingles engage each other. When shingles are installed in courses on a roof, the material of the self-seal strips (e.g. adhesive, asphalt, tar, etc.) melts as the shingles are warmed by sunlight to seal each course of shingles to the next lower course of shingles and thereby resist wind lift.

A typical self-seal strip is made up of a series of adhesive dashes separated by gaps. The dashes provide adhesion and sealing while the gaps allow drainage of any water that may seep beneath or condense between overlapping shingles. The adhesive dashes may be applied during shingle manufacturing by rotating applicator wheels having spaced apart peripheral lands carrying adhesive. The lands engage shingle stock as it moves along a processing path to transfer the adhesive from the lands to the shingle stock creating a self-seal strip with a dash-and-gap pattern. The shingle stock is then cut into shingles such that the self-seal strips are located at a desired position or positions on each shingle.

A shortcoming of traditional self-seal strips is that they provide constant levels of adhesion and drainage along their lengths by default. However, shingles themselves do not call for constant levels of adhesion and drainage along their lengths. For example, increased adhesion is usually called for at the ends and corners of shingles to prevent wind-lift at these vulnerable areas while less adhesion is called for at the mid-portion of a shingle. Likewise, moisture drainage may be more needed near the ends of horizontally adjacent shingles than near their mid-portions. Traditional self-seal strips are generic and cannot provide customized and varying adhesion and water drainage along the length of a shingle. As a result, they are inefficient and generally consume significantly more adhesive than is actually required for optimal results.

A need exists for shingles with customized self-seal strips designed to provide more adhesion where it is needed and less where it is not and to provide optimized water drainage features. A need also exists for a method of manufacturing such shingles. It is to the provision of shingles and methods that address these and other needs that the present disclosure is primarily directed.

SUMMARY

Briefly described, shingles have self-seal strips made up of a pattern of dashes and/or dots of sealant or adhesive for securing shingles to underlying shingles. The dashes are separated by gaps for water drainage. The term "dashes" is used in this disclosure for simplicity. It will be understood, however, that "dashes" includes "dots" and vice versa. The self-seal strips are registered with their shingles so that the pattern of dashes and gaps occurs at the same locations or at designated locations on each shingle. The thickness, width, density, and/or profile of the sealant dashes can be varied based on their positions on the shingle, for example, based on their position relative to the teeth and/or the end of the shingle, to obtain optimum results without applying excessive sealant. Methods of fabricating such shingles also are disclosed. Advantages are increased wind lift resistance, reduced cost through optimized sealant usage, reduced sealant compression, reduced product distortion, and complete shingle sealing except for specific locations where water drainage is desired.

In an embodiment, a roofing shingle comprises an upper surface having a headlap portion configured to be overlapped by a next roofing shingle in a next higher course of roofing shingles and an exposure portion adapted to be exposed to the elements. The roofing shingle also comprises a lower surface opposite the upper surface; and a self-seal strip applied to the lower surface. The self-seal strip extends along a length of the roofing shingle and includes a plurality of features. The features of the self-seal strip comprise a sealant material applied along a forward edge of the roofing shingle and having at least one drainage gap. The self-seal strip is registered with the roofing shingle so that at least a portion of the features of the self-seal strip are located adjacent corners of the roofing shingle formed between the forward edge and each side edge of the roofing shingle.

In an embodiment, a method comprises moving a roofing shingle material along a path, and progressively applying a self-seal adhesive to a surface of the moving roofing shingle material to form a self-seal strip having a predetermined or set pattern of features along its length. The features of the self-seal strip include drainage gaps defined at selected locations along the self-seal strip. The method additionally comprises cutting the roofing shingle material in synchronization with application of the self-seal adhesive to form roofing shingles each having at least one self-seal strip with features located at various positions along each roofing shingle. These positions include corners defined between a forward edge and each side edge of each roofing shingle.

In an embodiment, a roof comprises a roof deck, and a plurality of roofing shingles positioned on the roof deck. Each of the roofing shingles comprises an upper surface having a headlap portion configured to be overlapped by a next roofing shingle in a next higher course of roofing shingles and an exposure portion adapted to be exposed to the elements. And, each of the roofing shingles comprises a lower surface opposite the upper surface, and a self-seal strip applied to the lower surface, with the self-seal strip extending along a length of the roofing shingle and including a plurality of features that vary along a length of the self-seal strip. The features of the self-seal strip comprise applications of an adhesive material located at various selected positions along the roofing shingle adjacent a forward edge of the roofing shingle, and at least one drainage gap to enable drainage of water flows. The roofing shingles are arranged in overlapping courses on the roof deck with the headlap portion of each roofing shingle in a lower course are engaging a self-seal strip of an overlapping roofing shingle in a higher course along a portion of the forward edge thereof, including at corners defined between the forward edge and side edges of the roofing shingle and the overlapping roofing shingle.

The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

The following description is provided as an enabling teaching of embodiments of this disclosure. Those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances. Thus, the following description is provided as illustrative of the principles of the embodiments of the disclosure and not in limitation thereof, since the scope of the present disclosure is defined by the claims.

Figure 1:
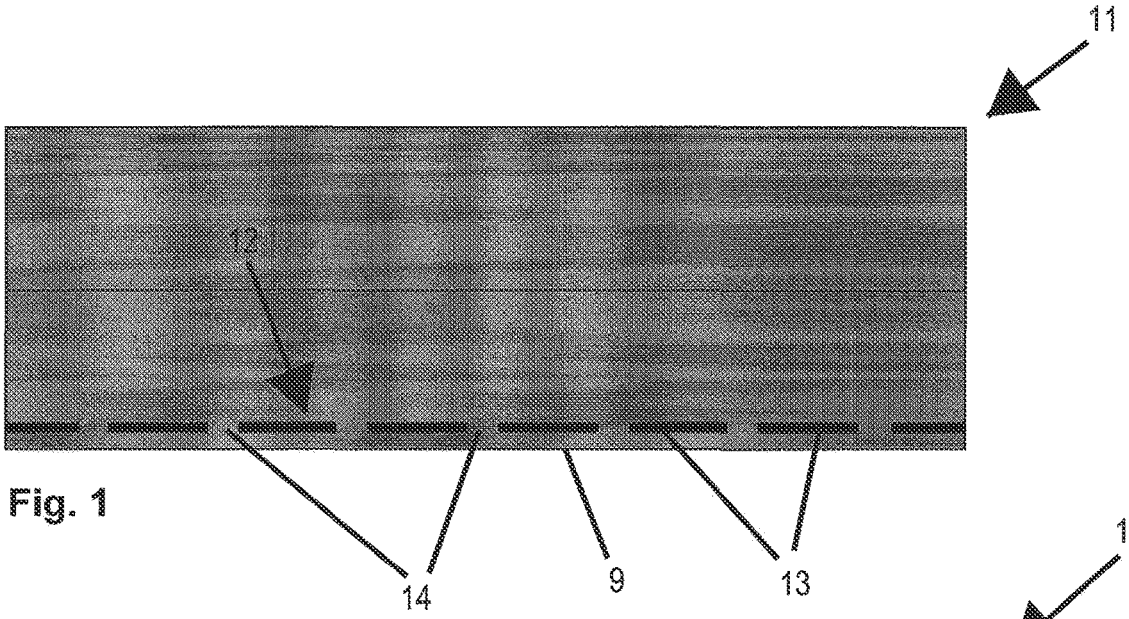
FIG. 1 shows a shingle with a self-seal strip having a uniform dash and gap pattern aligned with the shingle so that a dash always appears at each end of the shingle.

FIG. 1 shows the bottom surface of a shingle 11 with a self-seal strip according to an embodiment of the present disclosure. The shingle 11 may be a multi-layer architectural shingle such as a Timberline® brand shingle available from GAF. Such a shingle has another layer such as a dragon teeth layer (not visible) on its top surface. The shingle 11 is rectangular in shape and has a self-seal strip 12 applied to its bottom surface adjacent the forward edge 9 of the shingle.

The self-seal strip 12 is made up of features that, in this example, comprise a series of sealant dashes 13 separated by gaps 14. In some embodiments, "features" may include, but are not limited to, sealant dashes, sealant dots, gaps with no sealant, dashes with varying length, dashes with varying thickness, dashes with varying density, etc. In addition, while a single self-seal strip or line of sealant material is shown, in some embodiments, multiple lines of sealant materials also can be applied; for example, a second self-seal strip or line of sealant material could be applied to the lower surface of the shingle 9, spaced rearward from the forward edge 9 and self-seal strip 12.

In addition, in some embodiments such as shown in FIG. 1, the lengths of the sealant dashes 13 can be substantially constant and the lengths of the gaps also can be substantially constant. For example, as illustrated in FIG. 1, a pair of sealant dashes or other lengths of sealant material can be applied to the lower surface of the roofing shingle, extending from intermediate positions along the length of the roofing shingle to the side edges and/or the corners defined between the forward edge and each side edge, with a drainage gap separating the pair of sealant features. However, unlike the prior art, the self-seal strip (or strips if multiple self-seal strips are provided) is registered with the shingle such that a full sealant dash is located at each end of the shingle. While this is a simple pattern, it ensures that the forward edge of the shingle is always sealed adequately at its ends to an underlying shingle. This, in turn, provides reliable wind lift resistance at the ends of each shingle where wind lift is most prominent.

Figure 2:
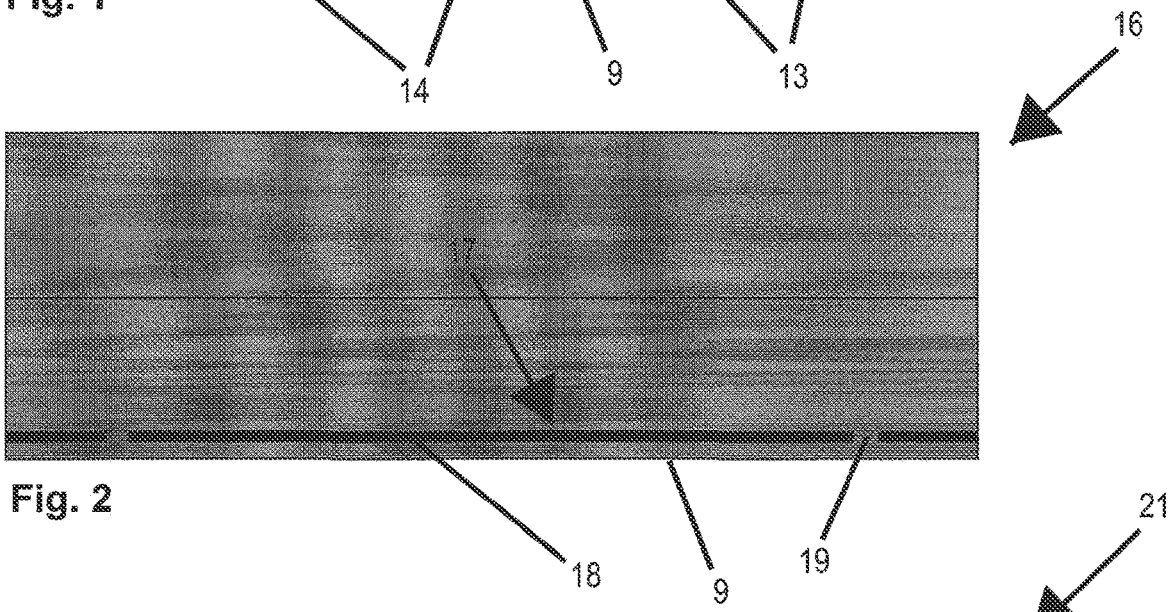
FIG. 2 shows a shingle with a self-seal strip having a semi-continuous dash and gap pattern with dashes at the ends of the shingle and in the mid-portion of the shingle and with water drainage gaps at strategic locations.

FIG. 2 illustrates the bottom surface of a shingle 16 having a self-seal strip 17 applied adjacent its forward edge 9. In this example, the self-seal strip 17 is semi-continuous in that it is made up of sealant dashes at each end (e.g., each side edge) of the shingle, a long sealant dash 18 in the mid-portion of the shingle, and a pair of gaps 19 separating the sealant dashes at the ends from the sealant dash in the mid-portion. Generally, but without limitation, a length of the sealant dashes at the ends of the shingle may be from ½ inch to 8 inches long and a length of the gaps 19 may be from ½ inch to 4 inches long. In other embodiments, the length of the sealant dashes can vary from 1 inch to 8 inches, 1½ to 7½ inches, 2 to 7 inches, 2½ to 6½ inches, 3 to 6 inches, 3½ to 5½ inches, or 4 to 5 inches; while the length of the gaps can vary from ½ to 3½ inches, ½ to 3 inches, ½ to 2½ inches, ½ to 2 inches, ½ to 1½ inches, or ½ to 1 inches. Other lengths and/or configurations of the sealant dashes and gaps therebetween also can be used.

As shown in FIG. 2, dash 18 generally spans the remainder of the width of the shingle. The self-seal strip 17 is registered with the shingle 16 so that the sealant dashes and the water drainage gaps are positioned at various locations along the length of the shingle 16. A shingle of this example can provide enhanced adhesion between shingles but positions drainage gaps at locations where they are most effective.

Figure 3:
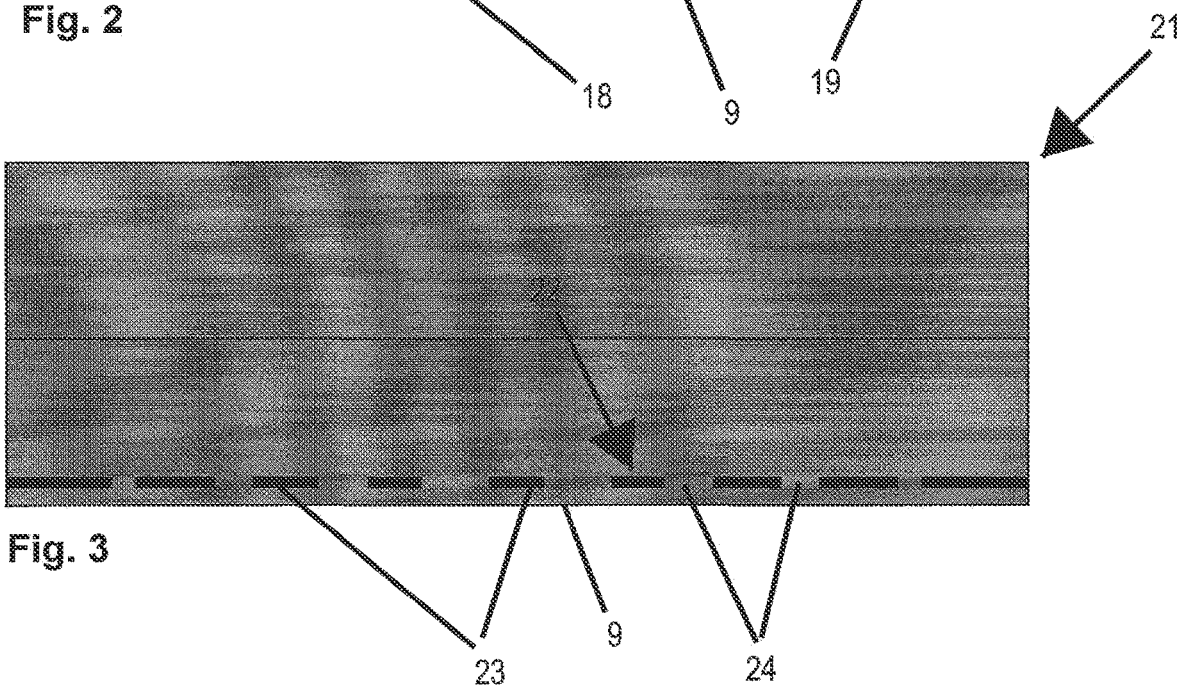
FIG. 3 shows a shingle with a self-seal strip registered with the shingle and made of sealant dashes and gaps of varying lengths in an optimized pattern.

FIG. 3 illustrates the bottom surface of a rectangular shingle 21 having a self-seal strip 22 applied to the shingle adjacent its forward edge 9. Here, the self-seal strip 22 is made up of sealant dashes 23 separated by gaps 24. The lengths of the sealant dashes 23 vary along the length of the self-seal strip and the lengths of the gaps 24 also vary. For instance, the sealant dashes 23 are shortest in a mid-portion of the shingle and become gradually longer toward end portions of the shingle (e.g., a length of the dots or dashes of the plurality of dots or dashes increases as the dots or dashes are positioned toward side edges of the roofing shingle). Likewise, the gaps are largest in the mid-portion of the shingle and become smaller toward the end portions of the shingle (e.g., a length of the drainage gaps decreases as the drainage gaps are positioned toward side edges of the roofing shingle). A longer sealant dash is located at each end of the shingle.

The self-seal strip of this embodiment may be referred to as an "optimized" self-seal strip, meaning that the amount of adhesion and water drainage capabilities vary along the shingle according to the adhesion and draining needs at various locations. For instance, more sealant is located at the ends of the shingle where wind lift resistance is most needed while less sealant is used in the mid-portion of the shingle where wind lift forces are lowest. The sealant is applied only where it is required and only in the amounts required, thereby minimizing sealant usage while maintaining maximum performance.

Figure 4:
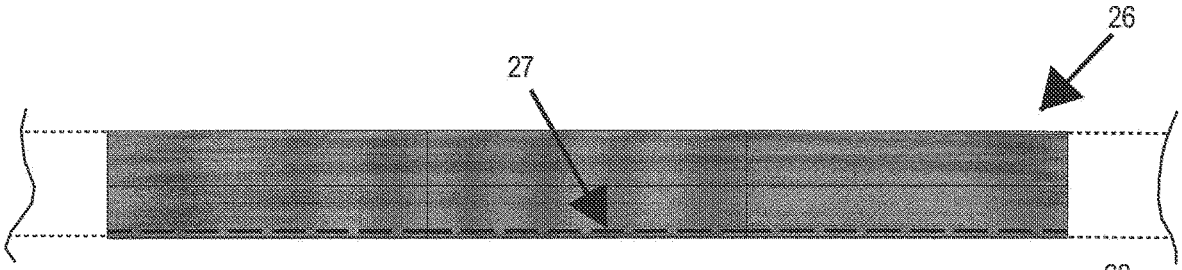
FIG. 4 illustrates application of the self-seal strip of FIG. 1 to a length of shingle stock during manufacture in such a way that the self-seal strip of each shingle is registered when shingles are cut from the shingle stock.

FIG. 4 shows a self-seal strip 27 of the type shown in FIG. 1 applied to a length of shingle stock 26 during manufacture and before shingles are cut from the stock. Vertical lines indicate locations where the strip will later be cut by a chop cutter and three complete shingles are illustrated. As discussed below, the self-seal strip may be applied with an application wheel that, in this embodiment, has a peripheral circumference three times the length of a single shingle. FIG. 4 (and FIGS. 5 and 6) show the results of one rotation of the application wheel.

It can be seen that the self-seal strip 27 of FIG. 4 is made up of sealant dashes separated by gaps and that the self-seal strip is registered with the cutting locations to provide the same self-seal strip pattern on each shingle once cut. For example, a longer sealant dash is centered on each cutting location. When the strip of shingle stock is cut at these locations, a sealant dash ends up at each end of each shingle to provide wind lift resistance at the ends (see resulting individual shingles in FIG. 1).

Figure 5:
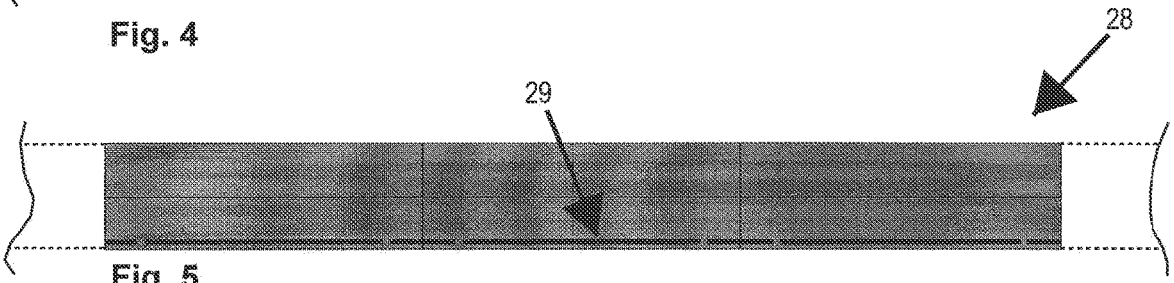
FIG. 5 illustrates application of the self-seal strip of FIG. 2 to a length of shingle stock during manufacture in such a way that the self-seal strip of each shingle is registered when shingles are cut from the shingle stock.

Similarly, FIG. 5 shows a self-seal strip 29 of the type shown in FIG. 2 applied to a length of shingle stock 28 during manufacture before shingles are cut from the stock. When cut at the indicated cutting locations, each shingle will bear the same semi-continuous self-seal strip pattern with sealant dashes at the ends of each shingle, a continuous sealant dash in the mid-portion of the shingle, and drainage gaps between the sealant dashes.

Figure 6:
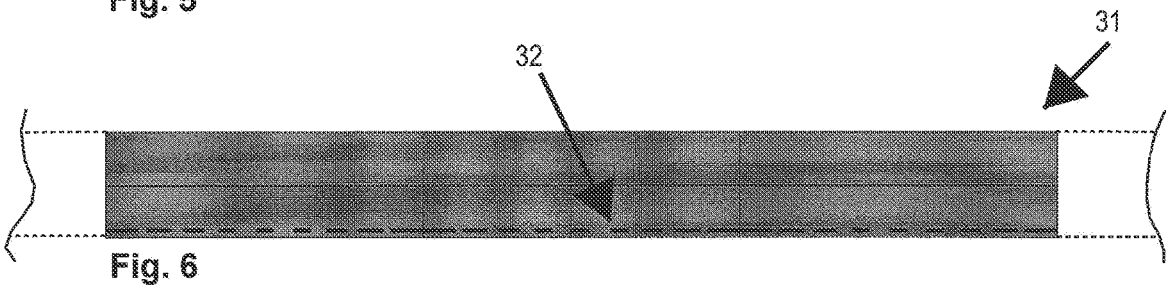
FIG. 6 illustrates application of the self-seal strip of FIG. 3 to a length of shingle stock during manufacture in such a way that the self-seal strip of each shingle is registered when shingles are cut from the shingle stock.

FIG. 6 shows a self-seal strip 32 of the type shown in FIG. 3 applied to a length of shingle stock 31 during manufacture before shingles are cut from the stock. The self-seal strip is registered with the shingle stock so that when it is cut into shingles at the indicated locations, the "optimized" self-seal strip pattern of FIG. 3 appears on each shingle.

Figure 7:
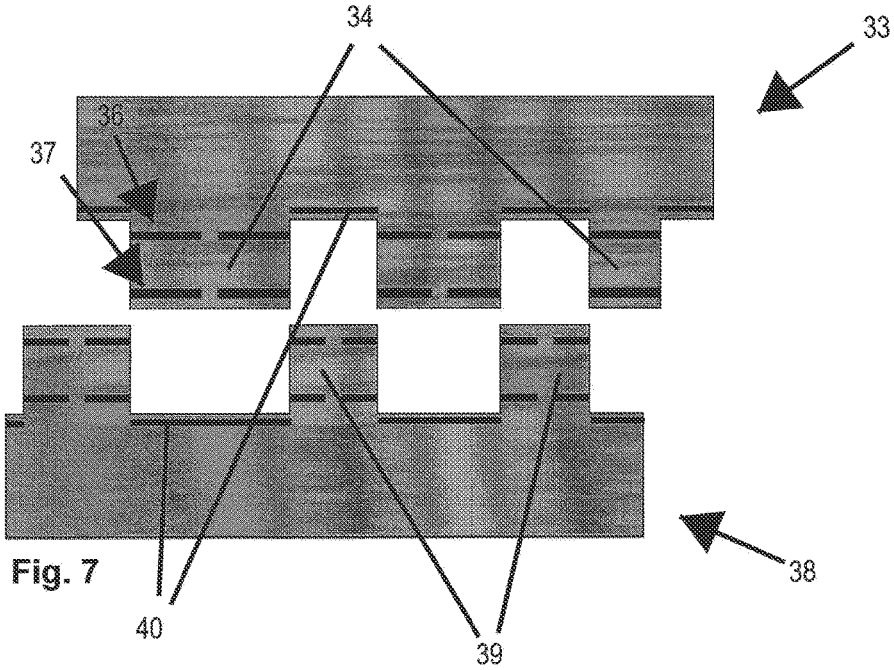
FIG. 7 shows self-seal strips applied to dragon teeth shingles and registered with the shingles to form a desired pattern on each dragon tooth of each shingle.

FIG. 7 illustrates principles of the present disclosure applied to the bottom surfaces of shingles that are laminated prior to being cut into dragon teeth patterns. An example of such shingles is Grand Canyon® brand shingles available from GAF. The principles of the present disclosure also can be applied to non-laminated shingles cut into dragon teeth patterns, or other patterns. Self-seal strips 36 and 37 are applied to the bottom surfaces of dragon teeth 34 and 39 and self-seal strips 40 are applied just above the cutouts of each shingle. When the shingles are installed in overlapping courses on a roof, the self-seal strips of shingles in one course adhere to shingles in the next lower course to secure the courses together and prevent wind lift. Further, a drainage gap is provided for most or all of the dragon teeth.

To accomplish this, a pair of self-seal strips is applied along the length of each dragon tooth as shown at 36 and 37 in FIG. 7. These self-seal strips are registered with the shingle to obtain a consistent dash-and-gap pattern on the bottom surface of most or all of the dragon teeth 34 and 39. The pattern in FIG. 7, for instance, is two spaced rows of self-seal strips on selected dragon teeth. For most dragon teeth, the strip is characterized by sealant dashes at the ends of the dragon tooth separated by a drainage gap between the dashes. In the example of FIG. 7, a third self-seal strip 40 is applied to the bottom surface of each shingle. The self-seal strip 40 is registered with the shingle so that a longer dash of sealant is applied just above each cutout. The self-seal strip 40 adheres shingles to underlying shingles to form a moisture barrier above the cutouts.

Figure 8:
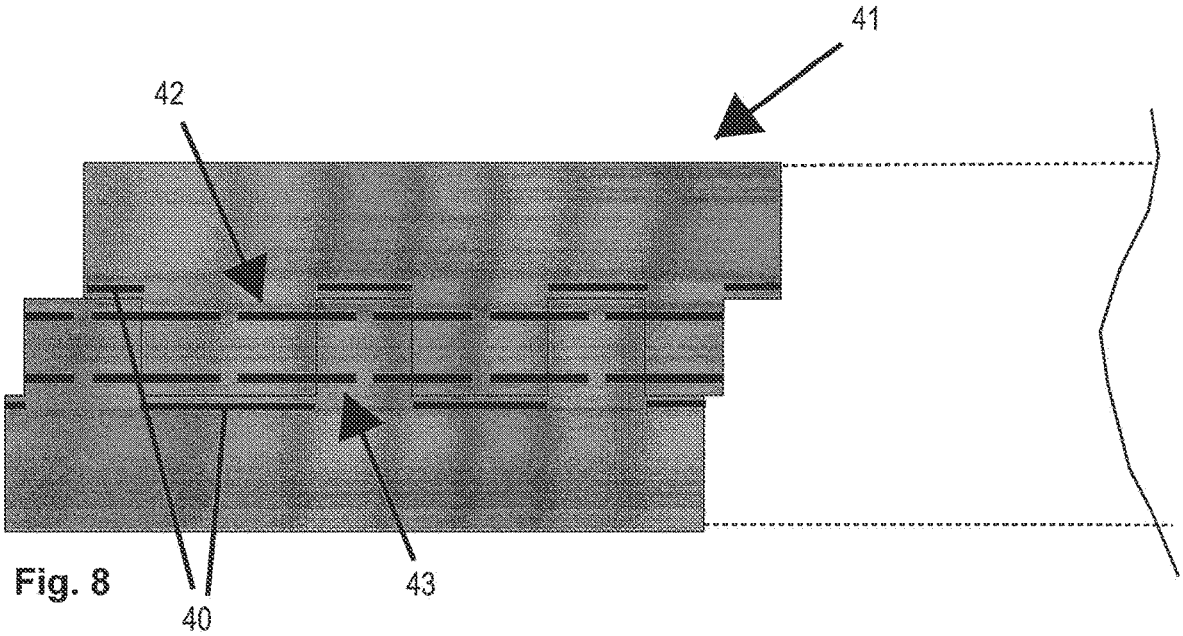
FIG. 8 shows application of the self-seal strips of FIG. 7 to a strip of shingle stock before the stock is cut into dragon teeth shingles.

FIG. 8 shows the bottom surface of a strip of shingle stock 41 during manufacture of shingles such as those of FIG. 7 and before the strip is cut into individual shingles. The outlines of the eventual cuts are shown. As detailed below, a sealant applicator wheel may be synchronized with the cutter that will cut the strip at the outlines so that the desired self-seal strip patterns 40, 42, and 43 will appear on each dragon tooth and above each cutout when the strip 41 is cut.

Figure 9:
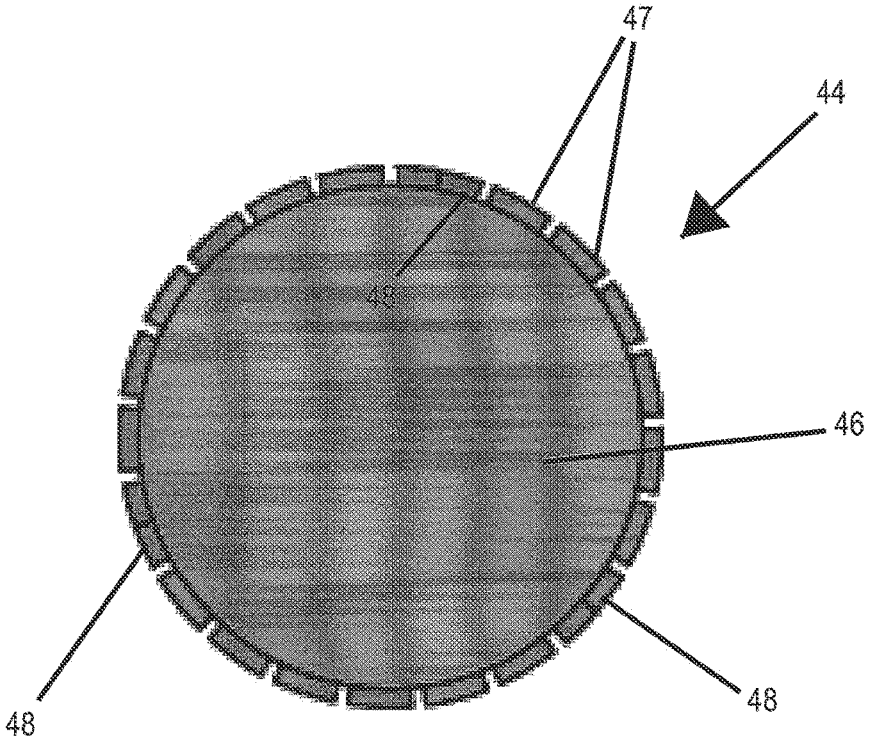
FIG. 9 illustrates a sealant application wheel usable to create the self-seal strip pattern of FIG. 1.

FIG. 9 illustrates an example of a sealant applicator wheel for creating the self-seal strip pattern shown in FIG. 1. As is known in the art, sealant applicator wheels typically have peripheral lands separated by gaps. The wheels rotate below a web of moving shingle stock. As the applicator wheels rotate, their lands pick up sealant from a sump and carry the sealant up to the surface of the shingle stock, where the lands kiss or engage the shingle stock and deposit the picked-up sealant. In FIG. 9, sealant applicator wheel 44 has a thin cylindrical hub 46. The periphery of the sealant applicator wheel carries an array of raised lands 47 separated by gaps.

Three of the lands 48 in this example are spaced at 120 degree increments around the wheel and have a surface length longer than the surface lengths of the other lands. The peripheral circumference of the applicator wheel of FIG. 9 is three times the length of a shingle so that a single rotation of the applicator wheel applies a self-seal strip to a length of shingle stock that will become three individual shingles. Rotation of the sealant applicator wheel is synchronized with operation of the downstream chop cutter. The longer lands 48 are positioned to deposit longer sealant dashes that span cutting locations on a length of shingle stock to create sealant dashes at the ends of shingles cut from the stock.

According to aspects of the present disclosure, the sealant application wheel 44 has a peripheral circumference that is a multiple of the final shingle length. In FIG. 9, for instance, the wheel 44 has a circumference that the three times the length of a shingle. The lands 47 are positioned on the wheel 44 to correspond to locations on finished shingles where sealant dashes are desired or needed. The spaces between lands are positioned to correspond to locations where drainage gaps are desired or needed. As mentioned, rotation of the sealant application wheel is synchronized with the operation of a downstream chop cutter that will cut the shingle stock into individual shingles.

Synchronization of sealant applicator wheels with the chop cutter can be established in various ways. In one embodiment, a fixed length is established between the sealant applicator wheel or wheels and the downstream chop cutter. In this way, the shingle stock is cut at specific and repeating locations relative to the features of the applied self-seal strips. In an alternative embodiment, servo or stepper motors controlled by a controller or artificial intelligence software may control operation of the chop cutter and/or the sealant applicator wheels to insure that shingles are cut at desired locations relative to the features of applied self-seal strips. For example, rotation of the sealant applicator wheels and or rotation of the chop cutter may be varied based upon the varying path length from the measurement of the free loop length. In each embodiment, applied self-seal strips are registered with all the shingles cut from the ribbon of shingle stock.

The sealant applicator wheel of FIG. 9, referred to as the wind lift resistant corners wheel, applies a longer dash of sealant from its longer lands 48 that extends on either side of each cut location between shingles. The result are shingles such as those shown in FIG. 1 with sealant dashes that always are positioned at the ends of the shingle.

Figure 10:
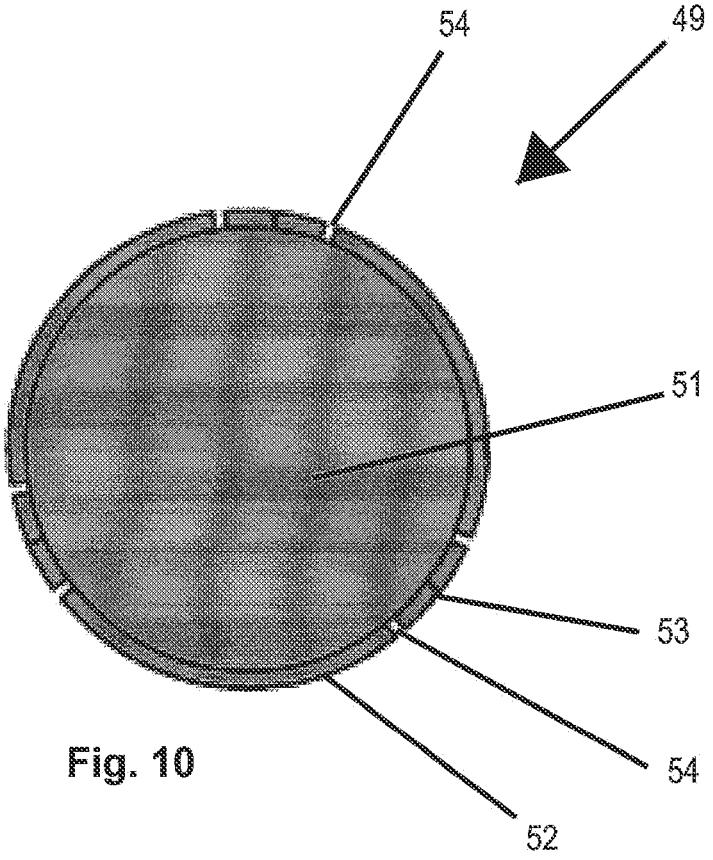
FIG. 10 illustrates a sealant application wheel usable to create the self-seal strip pattern of FIG. 2.

FIG. 10 shows a sealant applicator wheel 49 that may be used to apply semi-continuous self-seal strips, such as those shown in FIG. 2. The wheel 49 has a hub 51, long peripheral lands 52, and three short lands 53 with the lands being separated by gaps 54. This sealant applicator wheel 49, and the other embodiments discussed herein, has a peripheral circumference that is three times the length of a single shingle. This is not limiting, however, as other multiples of shingle length are possible. As the wheel 49 rotates, it picks up sealant from a sump and applies the sealant to shingle stock in such a way that the shingles of FIG. 2 are created. The resulting self-seal strip patterns provides complete bonding for substantially the full length of the shingle and also provides gaps located to allow water to drain at key locations. This, in turn, can prevent, reduce, or inhibit leaks behind the shingles.

Figure 11:
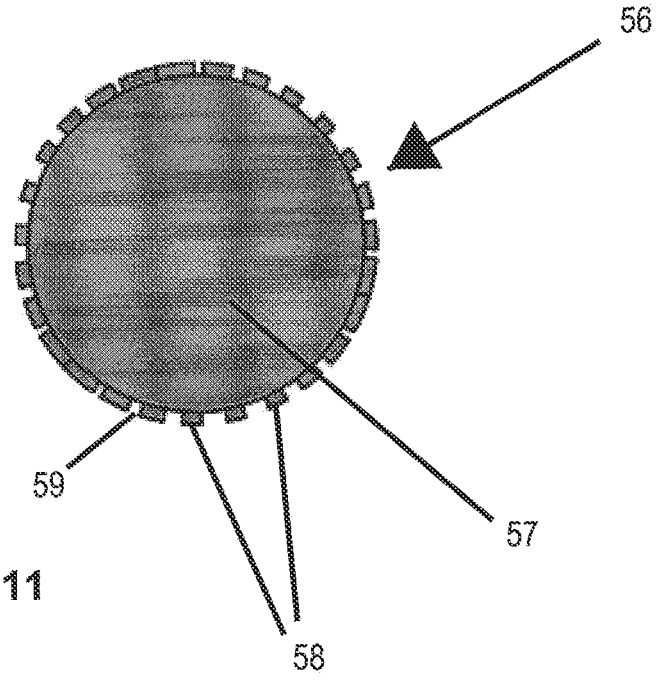
FIG. 11 illustrates a sealant application wheel usable to create the self-seal strip pattern of FIG. 3.

FIG. 11 illustrates another embodiment of a sealant applicator wheel 56 configured to apply optimized self-seal strip patterns such as those shown in FIG. 3. Here, the hub 57 has peripheral lands 58 that vary in length around the periphery of the wheel. Longer lands are located at positions that will correspond to cut locations along the shingle stock. The lands 58 are separated by gaps 59. The sealant applicator wheel 56 of FIG. 11 applies a reduced amount of sealant where it is not needed to maintain excellent performance. This reduces sealant needed per shingle and therefore reduces product cost with no performance degradation.

In other embodiments, the sealant pattern of dots, dashes, etc. . . . may be applied by various different applicators other than an applicator wheel. For example, the sealant may be ejected onto the lands (or directly onto moving shingle stock) from a slot die such as that shown in U.S. Pat. No. 9,795,981 owned by the applicant of the present application and incorporated herein by reference. In such an embodiment, the volume of sealant delivered to the slot die may be varied and synchronized with rotation of the sealant applicator wheel or movement of the shingle stock. Shingles resulting from such an embodiment may have self-seal strips that not only are registered with the shingles as discussed above, but that can vary in other features such as thickness, density, and width to name a few. Each dash and each gap can thus be custom tailored for its specific location on a shingle. For instance, and without limitation, thinner or narrower or less dense adhesive dashes can be applied where less adhesion is needed and thicker or wider adhesive dashes can be applied where more adhesion is needed. With this embodiment, the use and placement of adhesive can be finely tuned to result in the absolute least amount of adhesive use while maintaining superior performance.

The foregoing description generally illustrates and describes various embodiments of the present disclosure. It will, however, be understood by those skilled in the art that various changes and modifications can be made to the above-discussed construction of the present disclosure without departing from the spirit and scope of the disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the disclosure, and numerous variations, modifications, and additions further can be made thereto without departing from the spirit and scope of the present disclosure as set forth in the appended claims.

What is claimed is:

1. A roof, comprising:

a roof deck;

a plurality of roofing shingles positioned on the roof deck;

wherein each of the roofing shingles comprises:

an upper surface having a headlap portion configured to be overlapped by a next roofing shingle in a next higher course of roofing shingles and an exposure portion adapted to be exposed;

a lower surface opposite the upper surface; and a self-seal strip applied to the lower surface, the self-seal strip extending along a length of the roofing shingle and comprises a plurality of dots or dashes of sealant material applied along the lower surface with at least one drainage gap defined between at least two adjacent dots or dashes to enable drainage of water flows;

wherein a length of at least some of the dots or dashes increases as the dots or dashes are positioned toward each side edge of the roofing shingles;

wherein a length of the drainage gaps decreases as the drainage gaps are positioned toward each side edge of the roofing shingles;

wherein the roofing shingles are arranged in overlapping courses on the roof deck with the headlap portion of each roofing shingle in a lower course are engaging a self-seal strip of an overlapping roofing shingle in a higher course along a portion of a forward edge thereof.

2. The roof of claim 1, wherein the dots or dashes have a length from ½ inch to 8 inches, and wherein the drainage gaps have a length from ½ inch to 4 inches.

3. The roof of claim 2, wherein the plurality of dots or dashes further includes a dash or dot that is disposed between and larger than the dots or dashes positioned adjacent each side edge of the roofing shingles, and wherein the plurality of drainage gaps includes a pair of drainage gaps separating the dots or dashes at each side edge of the roofing shingles and the dash or dot disposed therebetween.

4. The roof of claim 1, wherein the dots or dashes of the self-seal strip comprise applications of the sealant material at a plurality of positions along the roofing shingle adjacent the forward edge of the roofing shingle.

5. The roof of claim 1, wherein the exposure portion further comprises a series of teeth, and wherein the dots or dashes of the self-seal strip are applied to the lower surface of each roofing shingle in positions relative to positions of the teeth.

6. The roof of claim 5, wherein the dots or dashes of the self-seal strip comprise at least two lines of dots or dashes of the sealant material extending along the lower surface of the roofing shingle opposite the teeth of the exposure portion; wherein the dots or dashes of each line of dots or dashes are separated by the at least one drainage gap.

7. The roof of claim 1, wherein the dots or dashes of the self-seal strip comprise one or more substantially continuous lengths of sealant material extending from an intermediate location along the lower surface to the side edges of the roofing shingle and separated by the at least one drainage gap.

8. The roof of claim 1, wherein at least a portion of the dots or dashes of the self-seal strip are located adjacent corners of the roofing shingle formed between a forward edge and each side edge of the roofing shingle.

9. The roof of claim 1, wherein at least a portion of the dots or dashes of the self-seal strip have a thickness that is greater than a thickness of another portion of the dots or dashes.

10. The roof of claim 1, wherein a width of the dots or dashes of the self-seal strip is varied based upon a location of the dots or dashes along the lower surface of the roofing shingle.

11. The roof of claim 1, wherein the exposure portion further comprises a series of teeth with cut-out portions defined therebetween, and wherein the dots or dashes of the self-seal strip comprise at least one line of dots or dashes of the sealant material extending along the lower surface of the roofing shingle opposite the teeth of the exposure portion, and at least one line of dots or dashes of the sealant material extending along the lower surface of the roofing shingle adjacent the cut-out portions.

12. A roofing shingle, comprising:

an upper surface having a headlap portion configured to be overlapped by a next roofing shingle in a next higher course of roofing shingles and an exposure portion adapted to be exposed;

a lower surface opposite the upper surface; and at least one self-seal strip applied to the lower surface, the self-seal strip including a plurality of features;

wherein the features of the self-seal strip comprise a plurality of dots or dashes of a sealant material applied in a pattern along the lower surface relative to a length of the shingle with at least one drainage gap defined between at least two adjacent dots or dashes;

wherein the plurality of dots or dashes includes dots or dashes at each side edge of the roofing shingle;

wherein at least some of the dots or dashes are of different sizes and increase in length as the dots or dashes are positioned toward each side edge of the roofing shingle; and wherein a length of the drainage gaps decreases as the drainage gaps are positioned toward each side edge of the roofing shingle.

13. The roofing shingle of claim 12, wherein the exposure portion further comprises a series of teeth, and wherein the dots or dashes of the self-seal strip are applied to the lower surface of the roofing shingle in positions relative to positions of the teeth.

14. The roofing shingle of claim 13, wherein the dots or dashes of the self-seal strip comprise at least two lines of dots or dashes of the sealant material extending along the lower surface of the roofing shingle opposite the teeth of the exposure portion; wherein the dots or dashes of each line of dots or dashes are separated by the at least one drainage gap.

15. The roofing shingle of claim 12, wherein the dots or dashes of the self-seal strip comprise one or more substantially continuous lengths of sealant material extending from an intermediate location along the lower surface to the side edges of the roofing shingle and separated by the at least one drainage gap.

16. The roofing shingle of claim 12, wherein the dots or dashes have a length from ½ inch to 8 inches; and the at least one drainage gap has a length from ½ inch to 4 inches.

17. The roofing shingle of claim 12, wherein the self-seal strip is registered with the roofing shingle so that at least a portion of the dots or dashes of the self-seal strip are located adjacent corners of the roofing shingle formed between a forward edge and each side edge of the roofing shingle.

18. The roofing shingle of claim 12, wherein at least a portion of the dots or dashes of the self-seal strip have a thickness that is greater than a thickness of another portion of the dots or dashes.

19. The roofing shingle of claim 12, wherein a width of the dots or dashes of the self-seal strip is varied based upon a location of the dots or dashes along the lower surface of the roofing shingle.

20. The roofing shingle of claim 12, wherein the exposure portion further comprises a series of teeth with cut-out portions defined therebetween, and wherein the dots or dashes of the self-seal strip comprise at least one line of dots or dashes of the sealant material extending along the lower surface of the roofing shingle opposite the teeth of the exposure portion, and at least one line of dots or dashes of the sealant material extending along the lower surface of the roofing shingle adjacent the cut-out portions.

* * * * *